US005168923A

United States Patent [19]

Sacks

[11] Patent Number: 5,168,923

[45] Date of Patent: Dec. 8, 1992

[54] METHOD OF MANUFACTURING A HEAT EXCHANGER PLATE FIN AND FIN SO MANUFACTURED

[75] Inventor: Paul S. Sacks, Cazenovia, N.Y.

[73] Assignee: Carrier Corporation, Syracuse, N.Y.

[21] Appl. No.: 788,953

[22] Filed: Nov. 7, 1991

[51] Int. Cl.[5] ..... F28F 1/30

[52] U.S. Cl. ..... 165/151; 165/181; 29/890.047

[58] Field of Search ..... 165/151, 181, 182; 29/890.047

[56] References Cited

U.S. PATENT DOCUMENTS

| | | | |
|---|---|---|---|
| 3,645,330 | 2/1972 | Albright et al. | 165/151 |
| 4,365,667 | 12/1982 | Hatada et al. | 165/152 |
| 4,434,844 | 3/1984 | Sakitani et al. | 165/151 |
| 4,469,167 | 9/1984 | Itoh et al. | 165/151 |
| 4,593,756 | 6/1986 | Itoh et al. | 165/151 |
| 4,691,768 | 9/1987 | Obosu | 165/151 |
| 4,723,599 | 2/1988 | Hanson | 165/151 |
| 4,787,442 | 11/1988 | Esformes | 165/151 |
| 4,832,117 | 3/1989 | Kato et al. | 165/151 |
| 4,860,822 | 8/1989 | Sacks | 165/151 |
| 4,909,319 | 5/1989 | Ishikawa et al. | 165/151 |
| 5,056,594 | 10/1991 | Kraay | 165/151 |

FOREIGN PATENT DOCUMENTS

| | | | |
|---|---|---|---|
| 726555 | 5/1932 | France | 165/151 |
| 60-60495 | 4/1985 | Japan | 165/151 |

*Primary Examiner*—Allen J. Flanigan

[57] ABSTRACT

A method of manufacturing a plate fin (11) for a plate fin and tube heat exchanger in which a sinusoidal enhancement pattern (14) having raised (22), lowered (21) and compound (23) lance elements is stamped into the area between pairs of adjacent fin collars (13) in the same row; also, a plate fin (11) produced by the method. The method minimizes the introduction of stresses into the fin material as well as the stretching and thinning of the material during the manufacturing process, allowing the production of enhanced sinusoidal patterns having relatively shorter wavelengths and relatively more complex enhancement patterns than prior art fins. The method also allows the use of relatively thinner sheet metal feedstock without risking damage to the fin during manufacture.

3 Claims, 3 Drawing Sheets

METHOD OF MANUFACTURING A HEAT EXCHANGER PLATE FIN AND FIN SO MANUFACTURED

BACKGROUND OF THE INVENTION

This invention relates to plate fin and tube type heat exchangers used in air conditioning, refrigeration and other applications. More particularly, the invention relates to a method of manufacturing a plate fin for use in such heat exchangers as well as the plate fin produced by the method.

Plate fin and tube heat exchangers are used in a wide variety of applications in which it is desired to exchange heat between two fluids, usually a pure liquid or a liquid undergoing a phase change to or from a gas, flowing within the heat exchanger tubes and a gas, usually air, flowing around the heat exchanger plate fins and tube exteriors. In such a heat exchanger, a plurality of thin plate fins are arranged parallel to each other between two tube sheets. Heat exchanger tubes pass through holes in the tube sheets and plate fins. There is a firm fit between the tubes and the plate fins so that the effective surface area, and thus the heat transfer area, of the heat exchanger tubes is increased by the area of the plate fins. Because of this increase in surface area, a plate fin and tube heat exchanger offers improved heat transfer performance over a plain tube type heat exchanger of the same size.

Prior art designers have devised numerous plate fin configurations. The configurations developed have attempted to improve the heat transfer performance of a given plate fin in two primary ways: (1) by maximizing, within the limits of the heat exchanger external dimensions, the plate fin surface area in contact with the gas flowing around the fins; and (2) by configuring the fin in such a way as to manage the distribution of fluid flow over the fin in order to minimize the thickness of a heat transfer inhibiting boundary layer on the external surfaces of the fin. One means of increasing the fin surface area is to corrugate the fin so that, for a given fin spacing, more fin surface area can be fit into the same volume. Corrugation also contributes to minimizing of the boundary layer.

Another means of promoting heat transfer by minimizing boundary layer thickness is to configure the fins with louvers or lances. A louver is a raised portion of the fin formed by first making a single slit into the fin and then raising the fin material on one side of the slit. A lance is a raised portion of the fin formed by first making two slits into the fin and then raising the fin material between the slits.

U.S. Pat. No. 4,860,822 (Sacks, issued Aug. 22, 1989), issued to the same inventor as the inventor of the present invention, describes a heat exchanger plate fin that incorporates more than one type of heat transfer performance enhancement. The '822 fin is corrugated in a sinusoidal pattern, with raised lance elements formed into the surface of the fin.

The holes in a heat exchanger plate fin through which the heat exchanger tubes pass are surrounded by collars formed in the fin. The function of the collars is twofold. First, they allow for a good mechanical bond between the fin and the tubes, thus enhancing heat transfer between the fin and the tubes. Second, the height of the tops of the collars from the base of the fin determines the spacing between adjacent fins and thus the number of fins per unit length of tube.

A heat exchanger incorporating plate fins such as the '822 fins exhibits excellent heat transfer performance. There are limitations, however, to the applications in which fins of the '822 type may be used. Specifically, there are lower limits on the thickness of the sheet feedstock that may be used as well as on tube diameter and corresponding wave length of the sinusoidal cross section; there are upper limits on the number, positioning and height of lance elements that may be formed in each enhanced heat transfer portion. These limitations arise because of the progressive stamping and forming operations by which fins of the '822 type are manufactured.

In manufacturing an '822 type fin, the first steps in the process are to form the fin collars and to impress the sinusoidal wave form into the fin. Then, the raised lances are formed in either one or two steps.

In the one step lance forming process, shaped punches cut slits into the sinusoidally formed fin. After cutting the slits, the punches continue their stroke into the fin material and displace the lance elements from the fin surface. This method requires very small clearances between mating tools, making spring loaded strippers necessary to push the lance regions back out of the die. Because these dies and strippers contain a comparatively large number of component parts, they are expensive to make and to maintain.

In the two step lance forming process, punches first cut slits into the sinusoidally formed fin. Then, in a subsequent step, shaped punches raise the fin material from the fin surface to form the raised lance elements. The shaped punches have controlled clearances between mating parts. The clearances obviate the need for spring assisted strippers and reduce the need for punch and die maintenance.

In manufacturing an '822 fin, drawing the fin collars and stamping in the sinusoidal wave form introduces localized stresses in the metal. Such stresses are greater when the amplitude of the sinusoidal pattern is increased and the wave length decreased. After slitting, relief of these localized stresses may occur through relative motion between the two edges of the slit. This motion can cause interference between adjacent edges and lead to edge burring when the lance elements are raised from the feedstock surface.

Raising the lance elements results in stretching and thinning of the metal at the ends of the lance elements. The stretching and thinning can result in tearing of the metal at those locations. Not only can a torn lance element end reduce heat transfer between the lance element and the main body of the fin, but also the reduced metal cross sectional area in the region of the lance element ends because of the thinning of the metal can reduce such heat transfer even if there is no tearing. And, of course, if both ends of the same lance element are torn, the element will become separated from the fin resulting in a loss of both the surface area and air flow advantages of the fin configuration.

The difficulties outlined above can and have been overcome in manufacturing plate fins of the '822 type by selecting a sheet feedstock of sufficient thickness and limiting the height that lance elements are raised from the sinusoidal surface so that the possibility of excessive thinning and tearing is minimized. In addition, the sinusoidal amplitude has been limited and the range of tubing sizes with which the fin is used has been limited to relatively larger diameters so that the sinusoidal wave length is long enough to avoid introduction of excessive residual stresses The raised lance elements on plate fins of the '822 type are sited at regions of maximum amplitude in the sinusoidal wave form. To manufacture raised lances of that configuration, the slitting die need have cutters that extend only two different distances from the main body of the die. If lance elements were to be formed at sites other than those of maximum amplitude, the slitting die must have cutters that extend over a relatively wide range of distances, resulting in a very complex die that would be difficult to fabricate and maintain. Further, during stamping to raise lance elements on the "slope," the elements would tend to be pulled down the "slope" and thus may not properly strip from the female portion of the forming die as the die is retracted after the stamping operation, resulting in damaged or improperly formed lance elements.

Heat exchanger plate fins of the '822 type are very effective at improving heat transfer in a plate fin and tube exchanger. Fins having even more lance elements can offer ever better performance. The effort to achieve increased heat transfer performance and to produce even more compact heat exchangers, means that smaller diameter tubing and narrower plate fins can and are being used in fin and tube exchangers. What is needed is a method of manufacturing that will produce a fin that is similar in configuration and equivalent in heat transfer performance to an '822 type fin and is also adaptable to producing a similar fin having an increased number of lance elements and a shorter sinusoidal wave length using thinner sheet feedstock.

SUMMARY OF THE INVENTION

The present invention is a method of manufacturing plate fins, for use in a plate fin and tube type heat exchanger. The scope of the invention also includes a plate fin having an area containing heat transfer performance enhancements comprising an overall sinusoidal corrugation with lance elements. The method of the invention may be used to produce the fin of the invention.

The method of the invention comprises successive stamping and cutting operations on metal sheet feedstock performed in conjunction with other similar operations that result in the production of a plate fin having enhancement areas comprising sinusoidal corrugations with lance elements. Fin collars are formed in the feedstock either before or simultaneously with the formation of the enhancement areas. The fin collars are formed in a row having a centerline that is parallel to the edges of the fin. An enhancement area is located between each pair of adjacent fin collars that are in the same row. The enhancement area is formed by first, while the sheet feedstock stock sheet is flat and undisturbed by other stamping operations, cutting slits, parallel to each other and to the fin edges, in the enhancement area. Then, certain of the strips of material between the slits are, by stamping, raised above one side or the other of the feedstock. Certain other of the strips may have one side raised and the other side lowered with respect to a single feedstock side. As the strips are stamped, the stamping dies impart an overall sinusoidal corrugation having within it either raised or lowered lance elements. The configuration of the enhancement area of an individual fin made according to the teaching of the invention is significantly different than prior art fins of the '822 type. But when a plurality of fins as described here are stacked together and assembled into a heat exchanger, the overall cross sectional configuration of the fin stack is very similar to a stack of '822 type fins.

The method of the invention is capable of use in manufacturing fin enhancement areas having even more complex configurations, including positioning of lance elements in regions of the sinusoid other than at points of maximum amplitude, with greatly reduced possibility of damage to the enhancement caused by the manufacturing process itself.

BRIEF DESCRIPTION OF THE DRAWINGS

The accompanying drawings form a part of the specification. Throughout the drawings, like reference numbers identify like elements.

DESCRIPTION OF THE PREFERRED EMBODIMENTS

Figure 1:
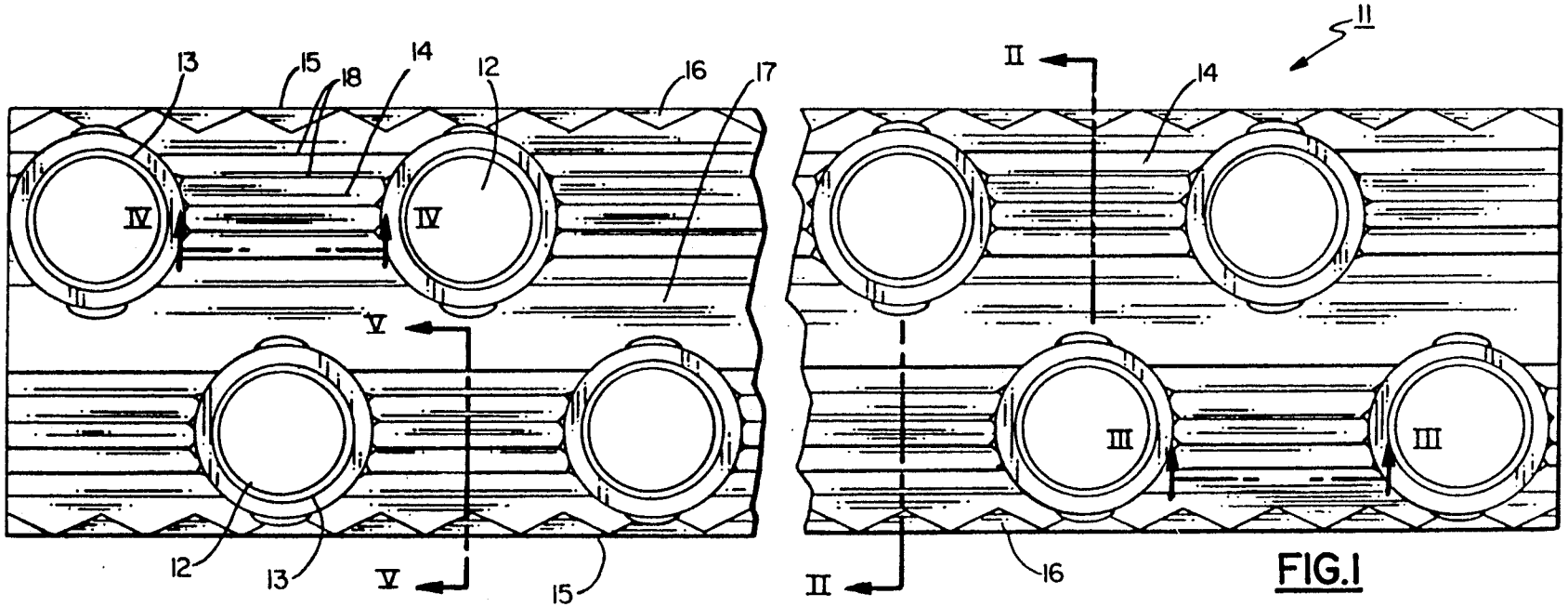
FIG. 1 is a plan view of a plate fin embodying the present invention.

FIG. 1 depicts heat exchanger plate fin 11, an embodiment of the present invention suitable for use in a plate fin and tube heat exchanger of the two row staggered tube type. The present invention may be embodied in plate fins to be used in heat exchangers of other configurations, from a single row arrangement to one with multiple rows and having tubes that are either staggered or not staggered.

Plate fin 11 has a plurality of tube holes 12 through it. The tube holes are arranged in rows, with all the holes in a given row having a common centerline that is parallel to fin edges 15. Between each adjacent pair of tube holes 12 in the same row is an enhancement area 14. Within enhancement area 14 are a plurality of longitudinal cuts 18. Surrounding each tube hole 12 is a fin collar 13. Between each vertical row of tube holes 12 is an inter-row area 17. Edges 15 may have edge treatments 16, for example a serrated or scalloped pattern, to improve appearance and resistance to further deformation of the edge.

Figure 2:
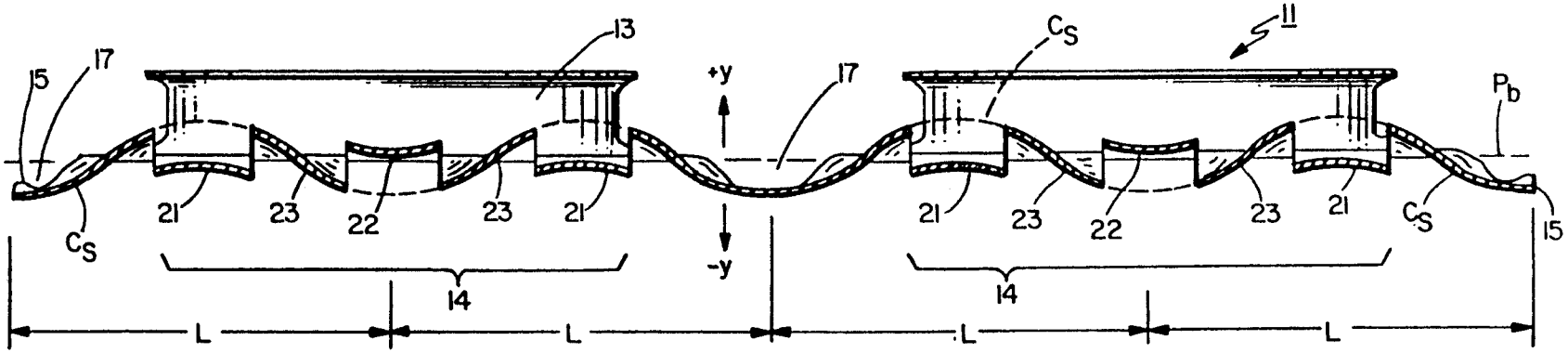
FIG. 2 is an elevation view of a lateral section, through line II—II in FIG. 1, of an embodiment the present invention.

FIG. 2 is an elevation view of a lateral section, through line II—II, of the embodiment of the present invention depicted in FIG. 1. Extending out from one side of plate fin 11 is fin collar 13. By the length to which they extend from the surface of the fin, the plurality of fin collars 13 serve to determine the spacing between the plurality of plate fins 11 in a given heat exchanger. The plurality of fin collars 13 also function to assure that there is sufficient area of contact and a close mechanical fit, and therefore good thermal conductivity, between the plate fins and the tubes.

Associated with plate fin 11 is fin collar base plane $P_b$. Arbitrary indicators of direction +y and −y define the direction of displacement from base plane $P_b$. One surface of the flat sheet feedstock from which plate fin 11 is manufactured is coincident with fin collar base plane $P_b$. Plate fin 12 has an overall sinusoidal corrugation $C_s$ of wavelength L that runs perpendicular to both edges 15 (FIG. 1) and to the common centerlines of the rows of tube holes 12. There are generally two corrugation wavelengths per row of tube holes.

Figure 3:
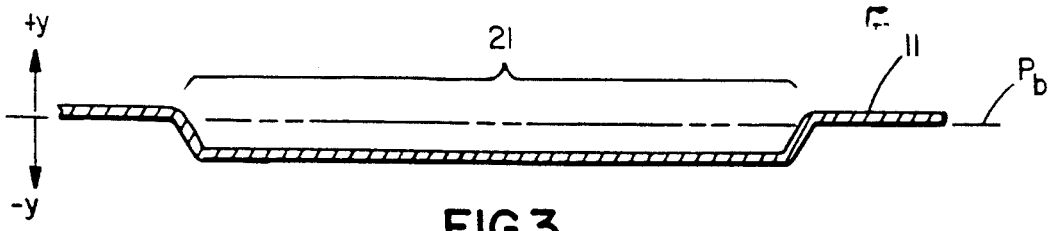
FIG. 3 is an elevation view of a longitudinal section, through line III—III in FIG. 1, of an embodiment the present invention.
Figure 4:
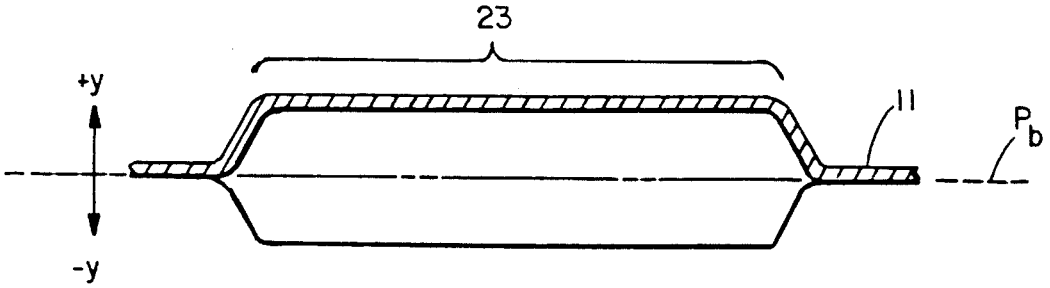
FIG. 4 is an elevation view of a longitudinal section, through line IV—IV in FIG. 1, of an embodiment the present invention.

Within enhancement area 14 and separated by longitudinal slits 18 (FIG. 1) are enhancement elements that form different portions of sinusoidal wave form $C_s$ and lance elements displaced from the wave. Lance elements 21 are displaced in the −y direction from base plane $P_b$. Lance element 22 is displaced in the +y direction from base plane $P_b$. Opposite edges of compound elements 23 are displaced in opposite directions from base plane $P_b$. FIG. 3 shows the configuration, in longitudinal section, of lance element 21. FIG. 4 shows the configuration, in longitudinal section, of compound element 23. It is the curvature of the surfaces of the various enhancement elements that form the sinusoid. The surfaces of the inter-row areas 17 are also curved to complete a sinusoidal wave form in the fin outside enhancement area 14.

Figure 5:
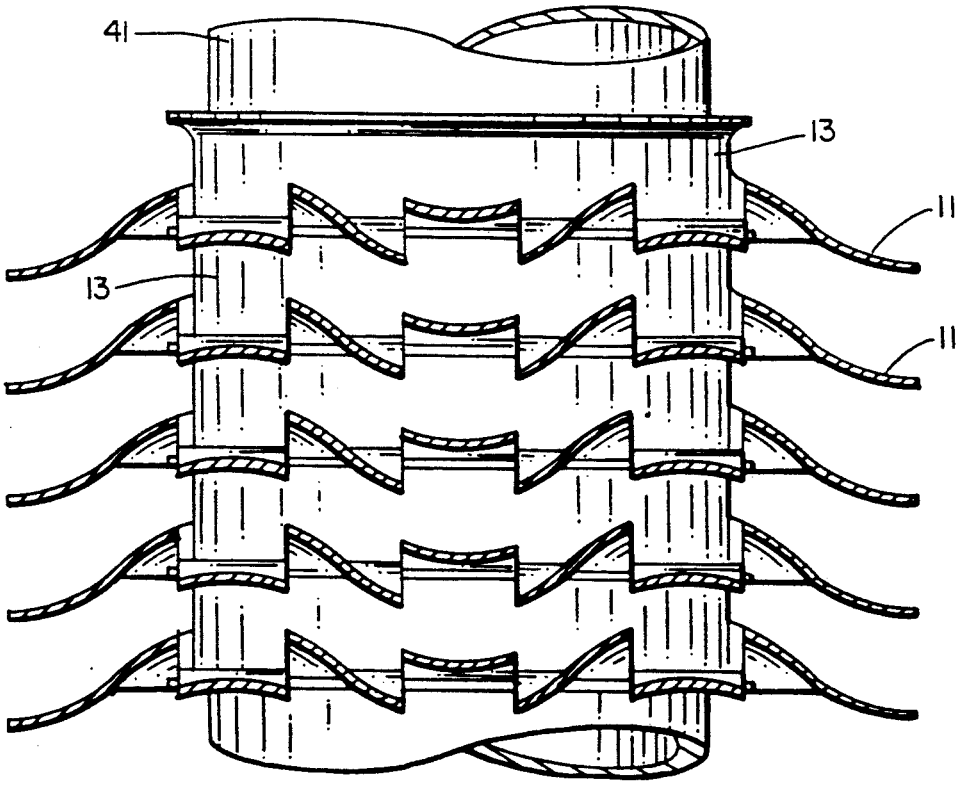
FIG. 5 is an elevation view of a lateral section, through line V—V in FIG. 1, of a plurality of embodiments of the present invention stacked with a heat exchanger tube inserted through fin collars in the stacked fins.
Figure 6:
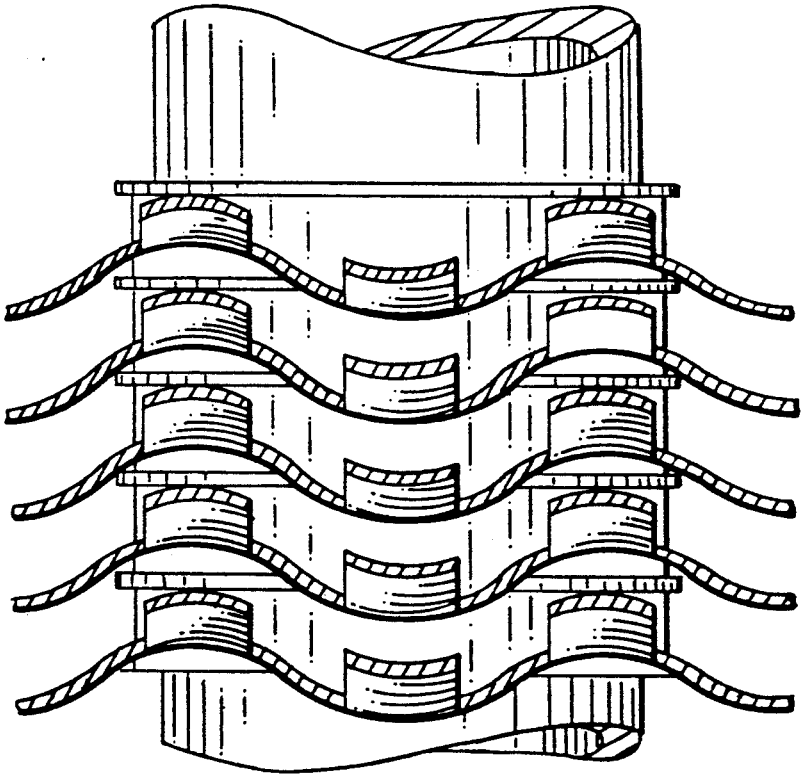
FIG.6 Prior Art
FIG. 6 is an elevation view of a lateral section of a plurality of prior art heat exchanger plate fins stacked with a heat exchanger tube inserted through fin collars in the stacked fins.

FIG. 5 is a sectioned partial elevation view of a plurality of plate fins 11 stacked together, with heat exchanger tube 41 passing through a fin collar 13 in each fin. FIG. 6 is a sectioned partial elevation view of a plurality of tube passing through a fin collar in each fin. FIG. 6 is derived from FIG. 5 of the '822 patent.

A comparison of FIGS. 5 and 6 shows that although the lateral cross section of a single plate fin 11 is very different from a cross section of a single prior art fin, a stack of plate fins 11 taken together has a cross section that is quite similar to the cross section of a stack of the prior art fins. The performance of a heat exchanger incorporating fins embodying the present invention is also comparable to the performance of a heat exchanger incorporating the prior art fins depicted in FIG. 6. However, the working and deformation of the sheet feedstock required to form plate fins embodying the present invention is very much less than that required to form the prior art fins. Thus it is possible to form sinusoidal waveforms of smaller wavelengths (for use with smaller diameter heat exchanger tubes) and to use metal sheet feedstock of lesser thickness than is possible with the configuration of the prior art fins.

Note that the term "sinusoidal" used in the above description means that the waveforms may be either true sine curves or "sine-like,"e.g. approximations of a true sine curve. Design requirements and practical considerations inherent in preparing tooling and in manufacturing the fins mean that the waveforms may not necessarily be mathematically rigorous sine curves.

Figure 7:
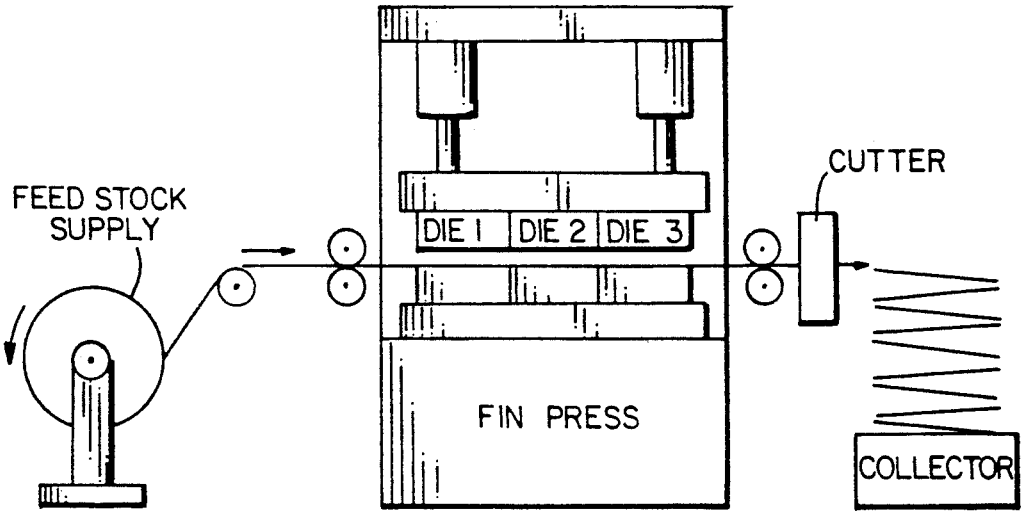
FIG. 7 is a schematic representation of the method of the invention.

FIG. 7 illustrates schematically the method of the invention. In the method, heat exchanger plate fins can be produced more or less continuously from a supply of sheet metal feedstock. The feedstock feeds into a fin press containing a number of fin forming dies. The feedstock progressively steps along through the press so that a given portion of the sheet is sequentially stamped by different dies. After the completing the stamping process, the continuous strip is cut to a desired width, if necessary, and a desired length to form a completed plate fin. The completed fin is collected by some suitable means for stacking and then for assembly into a plate fin and tube heat exchanger by other processes.

In the schematic diagram in FIG. 7, at DIE 1, the feedstock is stamped so as to cut longitudinal slits in enhancement area 14 (FIG. 1) of the finished fin. Then at DIE 2, the feedstock is stamped so as to complete the formation of the enhancement by forming lowered and raised lance elements 21 and 22 (FIG. 2), respectively, and compound elements 23 (FIG. 2). At DIE 3, the other details of the finished fin, including any edge configuration and the fin collars are formed.

FIG. 7 is merely a schematic to illustrate the method of the invention, in which the improvement over the prior art is to cut the longitudinal slits in the metal feedstock while it is still flat and unstressed from previous stamping and then to create the finished enhancement area by stamping to displace appropriate portions of the metal in the enhancement area above and below the original surfaces of the feedstock. In this way, the magnitude of the total displacement of the feedstock from its original, unworked condition is minimized and, as well, burring, tearing and stretching are also minimized.

In an actual fin manufacturing process, producing a finished fin can and frequently does require more than the three die stamping steps depicted in FIG. 7. Formation of the fin collar, in particular, can require more than three stamping steps. On the other hand, the operations represented by DIE 3 in FIG. 7 and enumerated in the discussion above need not be accomplished serially after the slitting and raising and lowering operations but, with appropriately designed dies, may be done in parallel.

A plate fin embodying the teaching of the present invention may be made of any suitable material, such as aluminum or copper.

What is claimed is:

1. In a manufacturing process for the production of an overall sinusoidally corrugated plate fin for a plate fin and tube type heat exchanger by progressive die stamping of a sheet metal feedstock having a longitudinal edge and a side, a method of manufacturing an enhancement area on said fin, said enhancement area having an overall sinusoidal surface corrugation within which are raised lance elements, lowered lance elements and compound elements, each of said elements having two edges, comprising the steps of cutting slits that are parallel to said longitudinal edge in said feedstock within said enhancement area before the metal within said enhancement area has been otherwise worked; and, in a subsequent operation, stamping said enhancement area to form a compound element, one of whose edges is raised from said side and the other of whose edges is lowered from said side, a raised lance element, both of whose edges are raised from said side and a lowered lance element, both of whose edges are lowered from said side, said elements being separated one from another by said longitudinal slits, so that, in lateral cross section, said enhancement area describes a sinusoidal corrugation having lance elements displaced from said corrugation and each said lance element has retained the form of the sinusoidal corrugation from which said lance element is either raised or lowered.

2. An improved plate fin (11) for a plate fin and tube heat exchanger, said plate fin having an edge (15), a first side, a second side, a fin collar base plane ($P_b$), a row of circular fin collars (13) having a common centerline that is parallel to said edge with each fin extending outward from said first side and from said fin collar base plane, and an overall sinusoidal corrugation, the improvement comprising:

enhancement areas (14) between pairs of said fin collars that are adjacent and in the same said row, said enhancement areas having raised lance (22), lowered lance (21) and compound elements (23) separated one from another by slits (18) that are parallel to said edge and to said centerline, each of said elements having a lateral cross section that is a segment of a sinusoidal corrugation, said raised lance elements being displaced outward from said first side, said lowered lance elements being displaced outward from said second side, and said compound elements having an edge displaced outward from said first side and an opposite edge displaced outward from said second side so that, in lateral cross section, said enhancement area describes a sinusoidal corrugation having an axis of symmetry that is coincident with said fin collar base plance and having lance elements displaced from said corrugation and, in lateral cross section, each said lance element has retained the form of the sinusoidal corrugation from which said lance element is either raised or lowered.

3. The plate fin of claim 2 in which a point on said sinusoidal corrugation of maximum amplitude outward from said second side lies on said common fin collar centerline, two points on said sinusoidal corrugation of maximum amplitude outward from said first side lie within said enhancement area and said enhancement area has one raised lance element centered laterally on said point of maximum amplitude from said second side, two lowered lance elements, each centered laterally at a point of maximum amplitude from said first side, a first compound element located between said raised lance element and one of said lowered lance elements and a second compound element, in lateral cross section a mirror image of said first compound element located between said raised lance element and the other said lowered lance elements.

* * * * *